US008569721B2

(12) United States Patent
Nakano et al.

(10) Patent No.: US 8,569,721 B2
(45) Date of Patent: Oct. 29, 2013

(54) EXTREME ULTRA VIOLET LIGHT SOURCE APPARATUS

(75) Inventors: Masaki Nakano, Yokohama (JP); Akira Endo, Tokyo (JP)

(73) Assignee: Gigaphoton Inc., Tochigi (JP)

( * ) Notice: Subject to any disclaimer, the term of this patent is extended or adjusted under 35 U.S.C. 154(b) by 188 days.

(21) Appl. No.: 12/372,958

(22) Filed: Feb. 18, 2009

(65) Prior Publication Data

US 2009/0218522 A1 Sep. 3, 2009

(30) Foreign Application Priority Data

Feb. 28, 2008 (JP) ..... 2008-047731

(51) Int. Cl.
*H05H 1/00* (2006.01)

(52) U.S. Cl.
USPC ..... 250/504 R; 250/493.1; 250/503.1

(58) Field of Classification Search
USPC ..... 250/506 R, 504 R; 372/69
See application file for complete search history.

(56) References Cited

U.S. PATENT DOCUMENTS

| | | | | |
|---|---|---|---|---|
| 6,855,943 | B2 * | 2/2005 | Shields | 250/504 R |
| 7,173,267 | B2 * | 2/2007 | Nakano | 250/504 R |
| 7,465,946 | B2 * | 12/2008 | Bowering et al. | 250/504 R |
| 7,477,673 | B2 * | 1/2009 | Ziener et al. | 372/87 |
| 7,608,846 | B2 * | 10/2009 | Nakano | 250/504 R |
| 7,838,854 | B2 * | 11/2010 | Algots et al. | 250/504 R |
| 2006/0024216 | A1 | 2/2006 | Hergenhan et al. | |
| 2006/0176925 | A1 * | 8/2006 | Nakano | 372/69 |
| 2006/0192154 | A1 * | 8/2006 | Algots et al. | 250/504 R |
| 2006/0193997 | A1 * | 8/2006 | Bykanov | 427/585 |
| 2006/0249699 | A1 * | 11/2006 | Bowering et al. | 250/504 R |
| 2006/0255298 | A1 * | 11/2006 | Bykanov et al. | 250/504 R |
| 2007/0170377 | A1 | 7/2007 | Nakano | |
| 2008/0035865 | A1 * | 2/2008 | Komori et al. | 250/504 R |

(Continued)

FOREIGN PATENT DOCUMENTS

| | | | |
|---|---|---|---|
| JP | 2006-074005 | A | 3/2006 |
| JP | 2007-200615 | A | 8/2007 |
| WO | WO-2006/093693 | A2 | 9/2006 |

OTHER PUBLICATIONS

J. Heinzl et al., "*Ink-Jet Printing*", Advances in Electronics and Electron Physics, U.S., Academic Press, 1985, vol. 65, pp. 91-171.

(Continued)

*Primary Examiner* — Nikita Wells
*Assistant Examiner* — Johnnie L Smith
(74) *Attorney, Agent, or Firm* — McDermott Will & Emery LLP

(57) ABSTRACT

In an LPP type EUV light source apparatus, the intensity of radiated EUV light is stabilized by improving the positional stability of droplets. The extreme ultra violet light source apparatus includes: a chamber in which extreme ultra violet light is generated; a target supply division including a target tank for storing a target material therein and an injection nozzle for injecting the target material in a jet form, for supplying the target material into the chamber; a charging electrode applied with a direct-current voltage between the target tank and itself, for charging droplets when the target material in the jet form injected from the injection nozzle is broken up into the droplets; a laser for applying a laser beam to the droplets of the target material to generate plasma; and a collector mirror for collecting extreme ultra violet light radiated from the plasma to output the extreme ultra violet light.

9 Claims, 6 Drawing Sheets

(56) References Cited

U.S. PATENT DOCUMENTS

| | | | | |
|---|---|---|---|---|
| 2008/0149862 | A1* | 6/2008 | Hansson et al. | 250/504 R |
| 2008/0179548 | A1* | 7/2008 | Bykanov et al. | 250/504 R |
| 2008/0283776 | A1* | 11/2008 | Algots et al. | 250/492.1 |

OTHER PUBLICATIONS

Japanese Office Action, and partial English translation thereof, issued in Japanese Patent Application No. 2008-047731 dated Sep. 4, 2012.

* cited by examiner

EXTREME ULTRA VIOLET LIGHT SOURCE APPARATUS

BACKGROUND OF THE INVENTION

1. Field of the Invention

The present invention relates to an extreme ultra violet (EUV) light source apparatus to be used as a light source of exposure equipment.

2. Description of a Related Art

Recent years, as semiconductor processes become finer, photolithography has been making rapid progress to finer fabrication. In the next generation, microfabrication of 100 nm to 70 nm, further, microfabrication of 50 nm or less will be required. Accordingly, in order to fulfill the requirement for microfabrication of 50 nm or less, for example, the development of exposure equipment is expected by combining an EUV light source generating EUV light having a wavelength of about 13 nm and a reduced projection reflective optics.

As the EUV light source, there are three kinds of light sources, which include an LPP (laser produced plasma) light source using plasma generated by applying a laser beam to a target (hereinafter, also referred to as "LPP type EUV light source apparatus"), a DPP (discharge produced plasma) light source using plasma generated by discharge, and an SR (synchrotron radiation) light source using orbital radiation. Among them, the LPP type EUV light source apparatus has advantages that extremely high intensity close to black body radiation can be obtained because plasma density can be considerably made larger, that light emission of only the necessary waveband can be performed by selecting the target material, and that an extremely large collection solid angle of $2\pi$ steradian can be ensured because it is a point source having substantially isotropic angle distribution and there is no structure surrounding the light source such as electrodes. Therefore, the LPP light source is considered to be predominant as a light source for EUV lithography requiring power of more than several tens of watts.

Here, a principle of generating EUV light in the LPP type EUV light source apparatus will be explained. By applying a laser beam to a target material supplied into a vacuum chamber, the target material is excited and plasmarized. Various wavelength components including EUV light are radiated from the plasma. Then, the EUV light is reflected and collected by using an EUV collector mirror that selectively reflects a desired wavelength component (e.g., a component having a wavelength of 13.5 nm), and outputted to an exposure unit. For the purpose, a multilayer film in which thin films of molybdenum (Mo) and thin films of silicon (Si) are alternately stacked (Mo/Si multilayer film), for example, is formed on the reflecting surface of the EUV collector mirror.

FIG. 7 shows a droplet target generating device and a part around the device in a conventional EUV light source apparatus. As a target material, for example, tin (Sn) melted into the liquid state, lithium (Li) melted into the liquid state, or a material formed by dissolving colloidal tin oxide fine particles in water or a volatile solvent such as methanol is used.

The target material introduced into a target tank 101 is pressurized with a pure argon gas or the like, for example, and a jet of the target material is ejected from an injection nozzle 102 attached to the leading end of the target tank 101 and having an inner diameter of several tens of micrometers. When regular disturbance is provided to the jet by using a vibrator (not shown) attached to the injection nozzle 102 or near the injection nozzle 102, a jet part 1*a* of the target material immediately breaks up into droplets 1*b* having homogeneous diameters, shapes, and intervals. The method of generating the homogeneous droplets in this manner is called a continuous jet method.

The generated homogeneous droplets 1*b* move within a vacuum chamber 100 according to the inertia when the jet is ejected from the injection nozzle 102, and a laser beam radiated from a $CO_2$ laser or YAG laser, for example, is applied thereto at a laser application point. Thereby, the target material is plasmarized and EUV light is radiated from the plasma. The droplets that have not irradiated with laser are collected by a target collecting unit 106 provided at the opposite side to the injection nozzle 102 with the laser application point in between.

However, in the conventional technology, the stability of the positions of droplets are gradually lost and the positions become unstable before the droplets reach the laser application point, and variations in positions are increased especially in the traveling direction of the droplets. As a result, the laser beam is no longer applied to the droplets constantly in the same condition, and there is a problem that the intensity of the radiated EUV light varies and, in the worst case, the laser beam is not applied to the droplets and no EUV light is generated. The trouble due to instability in positions of droplets becomes significant as the inner diameter of the injection nozzle 102 becomes smaller and the diameters of the droplets and intervals between the droplets become smaller.

FIG. 8 is a photograph of droplets generated by the droplet target generating device shown in FIG. 7. As the target material, melted tin is used. As shown in FIG. 8, the turbulence occurs in the positional stability of droplets at the laser application point, and the intervals between droplets are inhomogeneous and plural droplets are combined in some locations.

As one method of solving the problem, it is conceivable to apply laser beam to the droplets in a point where the positional stability of droplets is in a relatively good condition, that is, a point at a flying distance from the injection nozzle 102 is short (e.g., a point at a distance of about 50 mm from the injection nozzle 102). However, since the laser poser to be used in the EUV light source is 10 kW or more, the heat input to the injection nozzle 102 or the part around the nozzle is greater, the stably droplet generation is not maintained, and consequently, the performance of the EUV light source is deteriorated.

As a related technology, U.S. Patent Application Publication US 2006/0192154 A1 discloses EUV plasma formation target delivery system and method. The target delivery system includes: a target droplet formation mechanism comprising a magneto-restrictive or electro-restrictive material, a liquid plasma source material passageway terminating in an output orifice; a charging mechanism for applying electric charge to a droplet forming jet stream or to individual droplets exiting the passageway along a selected path; a droplet deflector positioned between the output orifice and a plasma initiation site, for periodically deflecting droplets from the selected path, a liquid target material delivery mechanism comprising a liquid target material delivery passage having an input opening and an output orifice; an electromotive disturbing force generating mechanism for generating a disturbing force within the liquid target material, a liquid target delivery droplet formation mechanism having an output orifice; and/or a wetting barrier around the periphery of the output orifice. However, US 2006/0192154 A1 does not particularly disclose improvements in positional stability.

Further, HEINZL et al., "Ink-Jet Printing", ADVANCES IN ELECTRONICS AND ELECTRON PHYSICS, U.S., Academic Press, 1985, Vol. 65, pp. 91-171 describes an explanation about the continuous jet method. According to HEINZL et al., the transformation from laminar to turbulentlike jet flow depends on the aspect ratio L/d of the nozzle, where "L" is the length and "d" is the diameter. Further, laminar-flow jets break up into a train of drops at some point due to surface tension. This is due to the fact that the surface energy of a liquid sphere is smaller than that of a cylinder having the same volume. Therefore, a jet of fluid column having, for example, a cylindrical shape is inherently unstable and will eventually transform itself into drops having a spherical shape (page 132).

SUMMARY OF THE INVENTION

The present invention has been achieved in view of the above-mentioned problems. A purpose of the present invention is to stabilize the intensity of radiated EUV light by improving the positional stability of droplets in an LPP type EUV light source apparatus.

In order to accomplish the above purpose, an extreme ultra violet light source apparatus according to one aspect of the present invention is an extreme ultra violet light source apparatus for generating extreme ultra violet light by applying a laser beam to a target material to turn the target material into a plasma state, and the apparatus includes: a chamber in which extreme ultra violet light is generated; a target supply division including a target tank for storing a target material therein and an injection nozzle for injecting the target material in a jet form, for supplying the target material into the chamber; a charging electrode applied with a direct-current voltage between the target tank and itself, for charging droplets when the target material in the jet form injected from the injection nozzle is broken up into droplets; a laser for applying a laser beam to the droplets of the target material to generate plasma; and a collector mirror for collecting extreme ultra violet light radiated from the plasma to output the extreme ultra violet light.

According to the present invention, since there is provided the charging electrode for charging the droplets when the target material in the jet form injected from the injection nozzle is broken up into the droplets, the intensity of the radiated EUV light can be stabilized by homogenizing the intervals between the droplets with the repulsive force between the droplets due to the electric charge.

DESCRIPTION OF THE PREFERRED EMBODIMENTS

Figure 1:
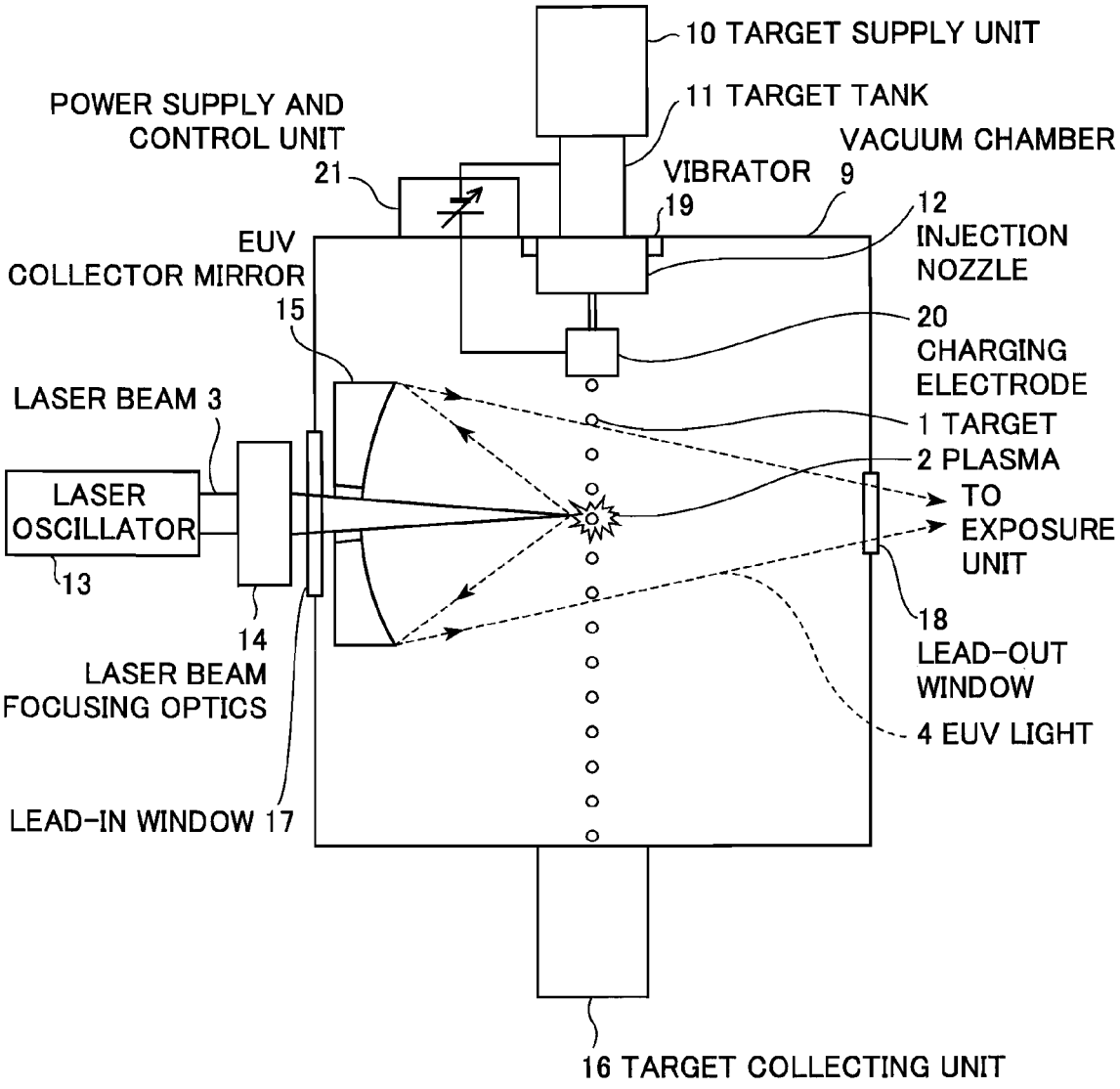
FIG. 1 is a schematic diagram showing an EUV light source apparatus according to the first embodiment of the present invention.

Hereinafter, preferred embodiments of the present invention will be explained in detail by referring to the drawings. The same reference characters are assigned to the same component elements and the description thereof will be omitted.

FIG. 1 is a schematic diagram showing an extreme ultra violet (EUV) light source apparatus according to the first embodiment of the present invention. The EUV light source apparatus adopts an LPP (laser produced plasma) type and used as a light source of exposure equipment.

As shown in FIG. 1, the EUV light source apparatus according to the embodiment includes a vacuum chamber (EUV light generation chamber) 9 in which EUV light is generated, a target supply unit 10 that supplies a target material, a target tank 11 for storing the target material therein, an injection nozzle (nozzle unit) 12 for injecting the target material in a jet form, a laser oscillator 13, a laser beam focusing optics 14, an EUV collector mirror 15, a target collecting unit 16, a vibration mechanism 19, a charging electrode 20, a power supply and control unit 21. Here, the target supply unit 10 to the injection nozzle 12 form a target supply division for supplying the target material into the vacuum chamber 9.

The vacuum chamber 9 is provided with a lead-in window 17 that leads in a laser beam (excitation laser beam) 3 for exciting a target 1 and generating plasma 2 into the vacuum chamber 9 and a lead-out window 18 that leads out EUV light 4 radiated from the plasma 2 to an exposure unit. The exposure unit as an output destination of the EUV light 4 is also provided in vacuum (or under reduced pressure) like the interior of the vacuum chamber 9.

The target supply unit 10 introduces the target material in the liquid state into the target tank 11, and supplies the target material stored in the target tank 11 to the injection nozzle 12 at a predetermined flow rate by pressurizing it with a pure argon gas or the like, for example.

As the target material, tin (Sn) melted into the liquid state, lithium (Li) melted into the liquid state, or a material formed by dissolving colloidal tin oxide fine particles in water or a volatile solvent such as methanol, or the like is used. For example, when tin is used as the target material, liquefied tin formed by heating solid tin, an aqueous solution containing tin oxide fine particles, or the like is supplied to the injection nozzle 12.

The injection nozzle 12 injects the supplied target material into the vacuum chamber 9. The target material is broken up and changes from the jet state into droplet state. In order to generate droplets at a predetermined frequency, the vibration mechanism (e.g., a PZT vibrator) 19 is provided for vibrating the injection nozzle 12 at the predetermined frequency. Further, a position adjustment mechanism for adjustment of the position of the injection nozzle 12 may be provided such that the target 1 as droplets may pass through the application position of the excitation laser beam 3.

The laser oscillator 13 outputs the excitation laser beam 3 to be applied to the target 1 by laser oscillation. The laser beam focusing optics 14 collects the laser beam 3 outputted from the laser oscillator 13 to apply it to the target 1 via the lead-in window 17.

The EUV collector mirror 15 has a concave reflecting surface and reflects a predetermined wavelength component (e.g., EUV light having a wavelength of 13.5 nm±0.135 nm) of the light emitted from the plasma and collects it toward the exposure unit. For the purpose, a multilayer film (e.g., an Mo/Si multilayer film) for selectively reflecting the wavelength component is formed on the reflecting surface of the EUV collector mirror 15. The number of layers of the multilayer film is typically about several tens to several hundreds. An opening for passing the laser 3 is formed in the EUV collector mirror 15.

The target collecting unit 16 recovers the target material that has been injected from the injection nozzle 12 but not irradiated with the laser beam 3 and has not contributed to plasma generation. Thereby, reduction in the degree of vacuum (rise in pressure) within the vacuum chamber 9 and contamination of the EUV collector mirror 15, the lead-in window 17, and so on are prevented.

In such an EUV light source apparatus, the target 1 in a droplet form is formed and the laser beam 3 is applied to the target 1 by laser oscillation, and thereby, the plasma 2 is generated. The light radiated from the plasma 2 contains various wavelength components at various energy levels. A predetermined wavelength component (EUV light) of them is reflected and collected toward the exposure unit by the EUV collector mirror 15. Thus generated EUV light is used as exposure light in the exposure unit.

Figure 2:
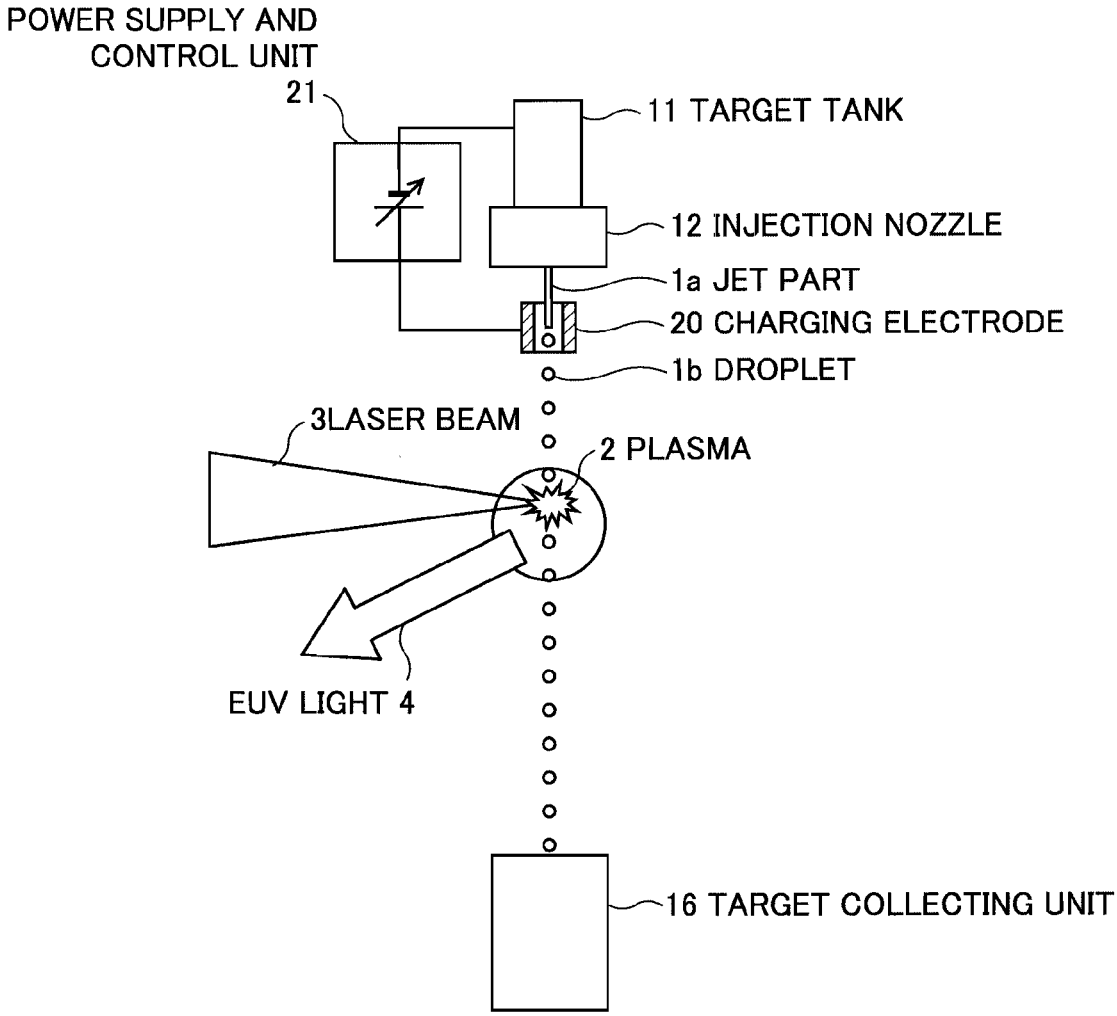
FIG. 2 shows a droplet target generating device and a part around the device in the EUV light source apparatus according to the first embodiment of the present invention.

FIG. 2 shows a droplet target generating device and a part around the device in the EUV light source apparatus according to the first embodiment of the present invention. As shown in FIG. 2, the target material is in the jet state (a jet part 1*a*) immediately after injected from the injection nozzle 12, and changes into the droplet state (droplets 1*b*) at a predetermined distance from the injection nozzle 12.

The charging electrode 20 for charging the droplets is provided under the injection nozzle 12. In order to apply an electric field between the charging electrode 20 and the jet part 1*a* injected from the injection nozzle 12, the power supply and control unit 21 is provided for applying a constant direct-current voltage between the target tank 11 and the charging electrode 20. In the embodiment, the potential of the target tank 11 is set to the ground potential (0V) and a positive direct-current voltage is applied to the charging electrode 20.

Thereby, the jet part 1*a* functions as one electrode of a pair of electrodes. In this regard, electric charge depending on the voltage between the electrodes emerges at the leading end of the jet part 1*a*, and thus, while the jet part 1*a* is being broken up into homogeneous droplets 1*b*, the amount of electric charge accumulated in the respective droplets 1*b* becomes extremely homogeneous. Therefore, the respective droplets 1*b* will have the same mass and electric charge, and therefore, intervals between them are kept equal to each other by the repulsive force due to charge.

Figure 3:
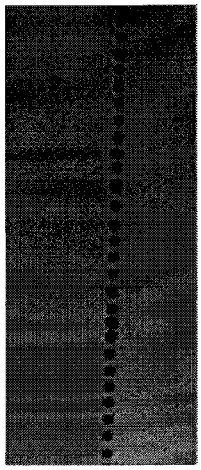
FIG. 3 is a photograph of droplets generated by the droplet target generating device shown in FIG. 2.
Figure 8:
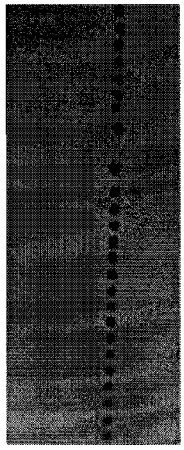
FIG. 8 PRIOR ART
FIG. 8 is a photograph of droplets generated by the droplet target generating device shown in FIG. 7.

FIG. 3 is a photograph of droplets generated by the droplet target generating device shown in FIG. 2. As the target material, melted tin is used. This photograph is taken at the same observation location as the observation location of the conventional technology in FIG. 8, and it is known that intervals between the droplets are kept equal to each other due to charge of the droplets.

The charging electrode 20 shown in FIG. 2 may take a cylindrical shape, a parallel plate shape, a ring shape, or the like, and the cylindrical charging electrode 20 is used in the embodiment. Further, the droplet generation position where the jet part 1*a* changes to droplets 1*b* is desirably within the charging electrode 20. In this case, effective charging of the droplets 1*b* becomes possible according to the theoretical equations explained as below, and the positional stability of the droplets 1*b* can be improved by a simple configuration and a small voltage.

Figure 4:
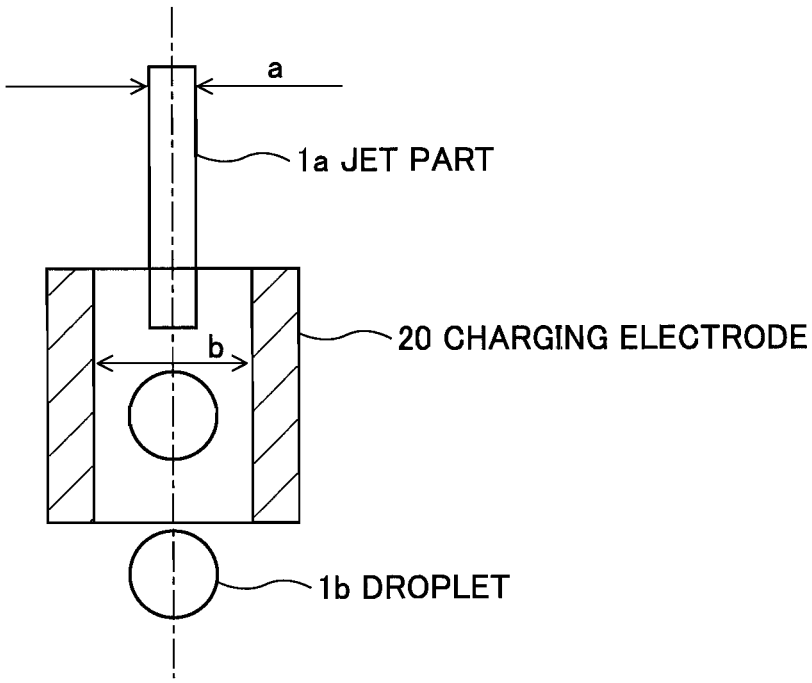
FIG. 4 is a diagram for explanation of changing of a target material by a charging electrode.

FIG. 4 is a diagram for explanation of changing of the target material by the charging electrode. As shown in FIG. 4, when the charging electrode 20 has a cylindrical shape, the amount of charge "Q" of one droplet is expressed by the equation (1) of the charge emerging at the electrode of a coaxial capacitor.

$$Q=2\pi\epsilon\cdot V\cdot v_J/\{f\cdot\log(b/a)\} \quad (1)$$

where "ϵ" is permittivity of vacuum, "V" is a voltage applied to the charging electrode 20, "$v_J$" is an injection velocity of the target, "f" is a generation frequency of the droplets 1*b* (vibration frequency of the vibrator), "a" is a diameter of the jet part 1*a*, and "b" is a diameter (inner diameter) of the cylindrical charging electrode 20.

On the other hand, the repulsive force "F" between the droplets is expressed by the following equation (2).

$$F=k\cdot Q^2/L^2$$

where "k" is a proportional constant, "L" is an interval between droplets. When the amounts of charge "Q" of the droplets becomes excessive, the repulsive force "F" between the droplets becomes too strong, the droplets are displaced in a direction perpendicular to the traveling direction, and the row of the droplets becomes out of line.

For example, in experiments using water, it is known that intervals are maintained with the row of the droplets in line under a condition that the acceleration by the repulsive force between charged droplets is equal to or less than 500 $m/s^2$ regardless of the size and interval of the droplets. On the other hand, the row of the droplets inevitably becomes out of line under a condition that the acceleration by the repulsive force between charged droplets is equal to or less than 2000 $m/s^2$ Therefore, the amount of charge of the droplets should be an amount of charge enough to make the intervals between droplets homogeneous and make the acceleration with which adjacent droplets do not repulsively act (according to the experimental result, about 500 $m/s^2$ or less).

Figure 5:
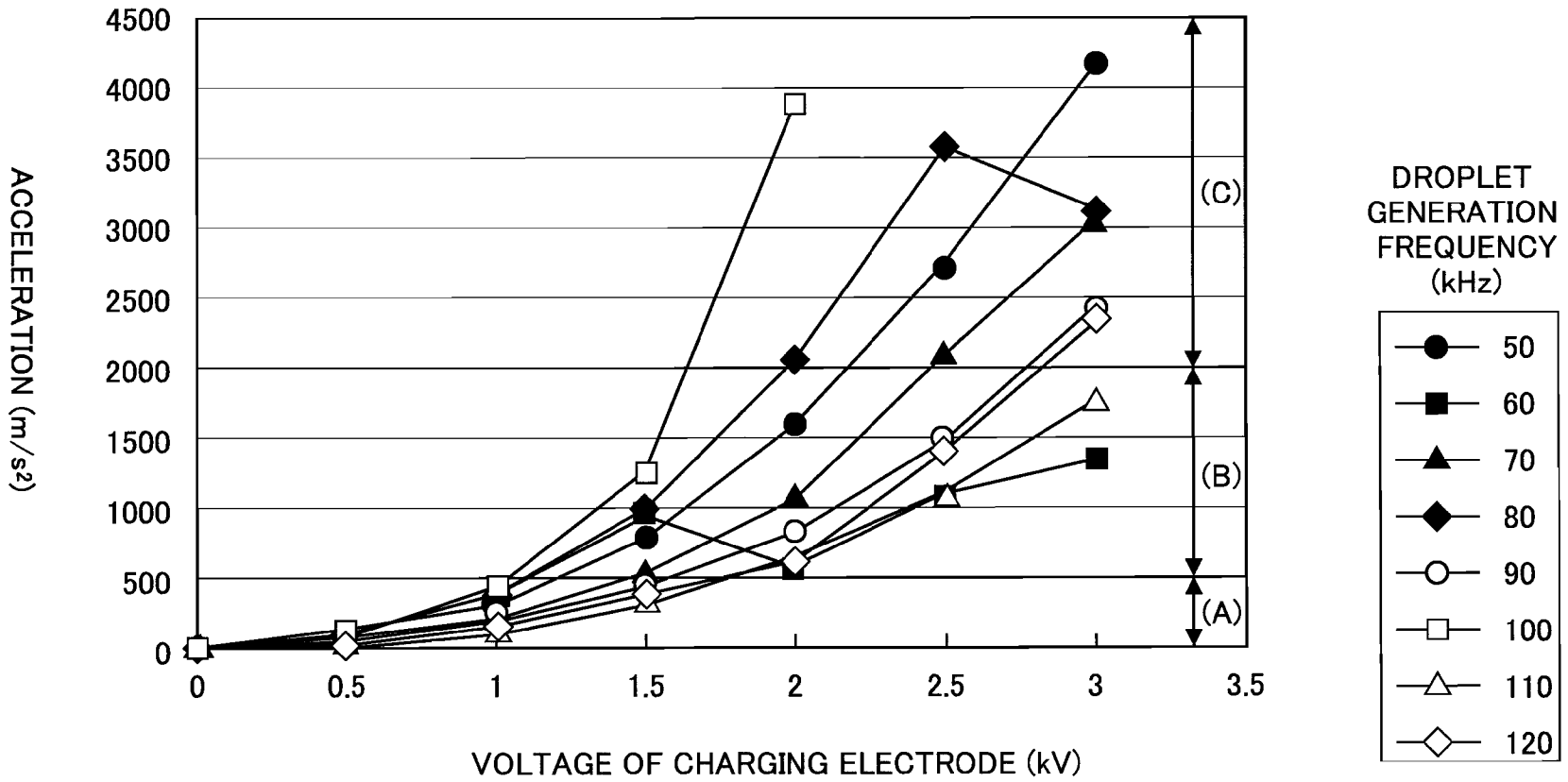
FIG. 5 shows relationships between the voltage of the charging electrode and the change in the acceleration generated in the droplets.

FIG. 5 shows relationships between the voltage of the charging electrode and the change in the acceleration generated in the droplets. In FIG. 5, the horizontal axis indicates the voltage (kV) of the charging electrode, and the vertical axis indicates the acceleration ($m/s^2$) by the repulsive force between the droplets. Further, the droplet generation frequency (kHz) is taken as a parameter.

In the acceleration shown in FIG. 5, range (A) is a stable range in which initial variations in position of droplets do not affect the subsequent positional relationship, range (B) is an intermediate range in which there is a possibility that the row of droplets may be out of line due to initial variations in position of droplets, and range (C) is an unstable range in which the row of droplets is inevitably out of line due to initial variations in position of droplets. According to FIG. 5, it is known that, if the voltage of the charging electrode is set to 1 kV or less, when the droplet generation frequency is at least 50 kHz to 120 kHz, the acceleration by the repulsive force between the droplets falls in the stable range (A).

Next, the second embodiment of the present invention will be explained.

Figure 6:
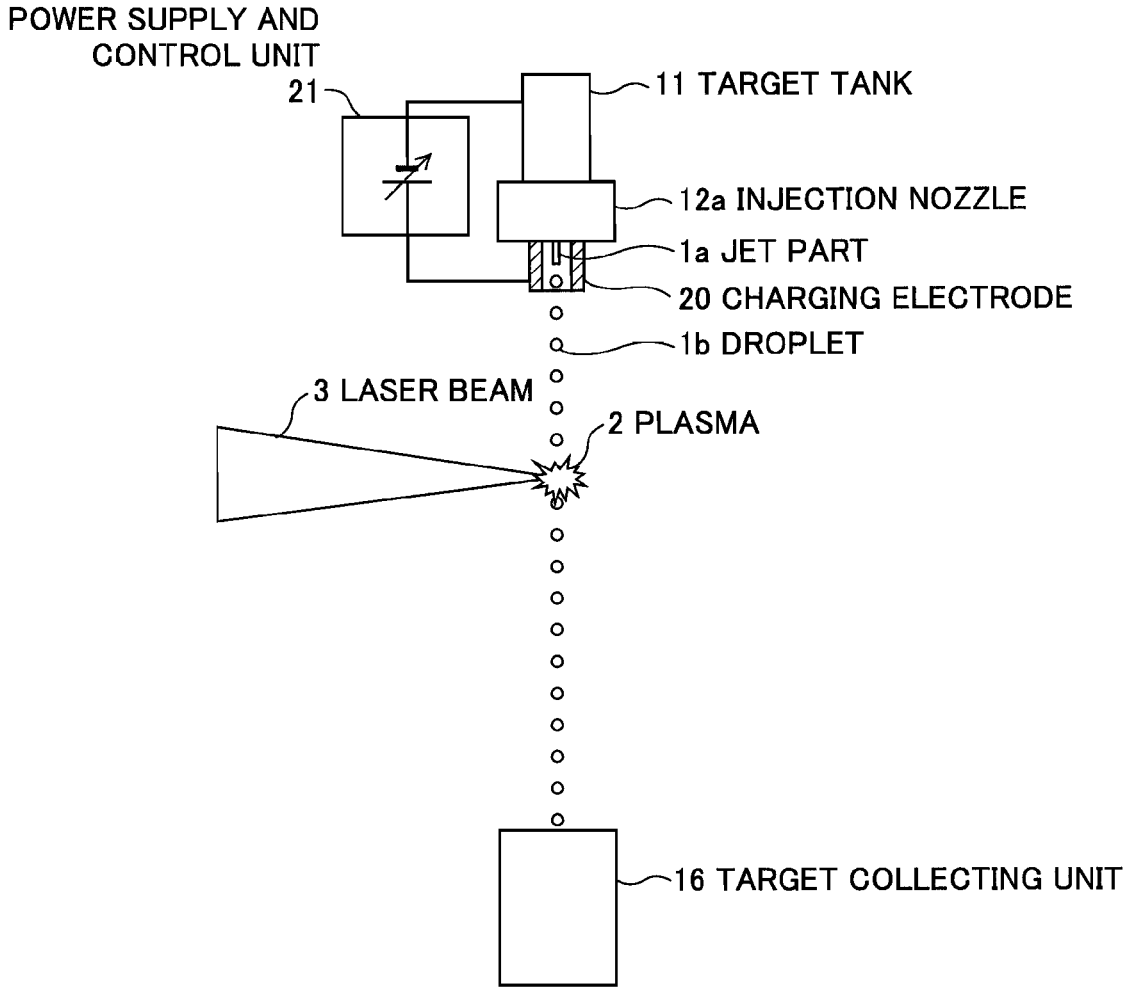
FIG. 6 shows a droplet target generating device and a part around the device in an EUV light source apparatus according to the second embodiment of the present invention.
Figure 7:
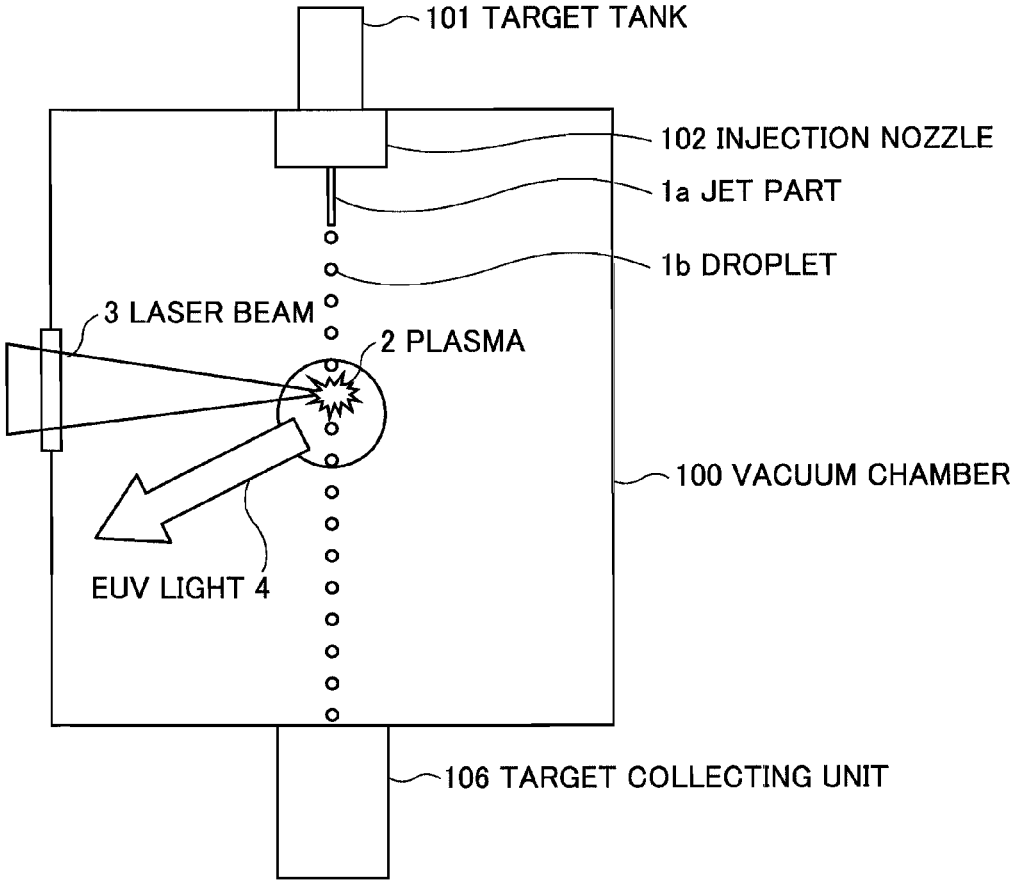
FIG. 7 PRIOR ART
FIG. 7 shows a droplet target generating device and a part around the device in a conventional EUV light source apparatus.

FIG. 6 shows a droplet target generating device and a part around the device in an EUV light source apparatus according to the second embodiment of the present invention. In the second embodiment, at least a part of an injection nozzle 12*a* has an electric insulation property. The rest is the same as that of the first embodiment.

Generally, the actual length of the jet part ejected from the injection nozzle is extremely short. For example, the length of the jet part is 1 mm or less in most cases when vibration is applied by a vibrator to the jet ejected from an injection nozzle having an inner diameter of 15 um at a velocity of 20 m/s and droplets are formed. Therefore, from a practical point of view, in order to allow the droplet generation position to exist within the injection nozzle in an ideal condition as explained in the first embodiment, it is necessary to place the charging electrode as close to the injection nozzle as possible.

However, since the voltage applied to the charging electrode is of the order of kV, when the injection nozzle has conductivity, a very large electric field is generated between the charging electrode and the injection nozzle. Accordingly, in the second embodiment, at least the part of the injection nozzle (nozzle unit) 12*a*, especially, the part close to the charging electrode 20 is formed of an insulating material such as ceramics, and thereby, the charging electrode 20 can be placed closer to the injection nozzle 12*a*.

More preferably, if the charging electrode 20 is directly attached to the insulating part of the injection nozzle 12*a*, even when a voltage of several kilovolts is applied to the charging electrode 20, breakdown do not occur between them and the relative positions of them are stable. In this case, even when the jet part 1*a* of the target is short, the droplet generation position can be allowed to exist within the charging electrode 20, and thereby, the droplets 1*b* can be charged in the ideal condition as explained in the first embodiment.

In fact, even in the case where the droplet generation position does not exist within the charging electrode 20 and the target becomes droplets at the upstream of the charging electrode 20, the droplets are charged by the charging electrode 20. According to the embodiment, since the charging electrode 20 can be placed close to the injection nozzle 12*a*, the droplets can be efficiently charged in that case.

The invention claimed is:

1. An extreme ultra violet light source apparatus for generating extreme ultra violet light from plasma generated by irradiating a target material supplied to a region with a laser beam introduced from an external unit, said apparatus comprising:

a chamber in which the plasma is generated;

a target supply division for supplying the target material to the region within said chamber, including a nozzle for supplying a stream of the target material into said chamber, at least a part of said nozzle having an electric insulation property, and including a target tank for pressurizing the target material stored therein with a gas to supply the target material to said nozzle, a potential of said target tank being set to a ground potential;

a charging electrode disposed between said nozzle and said region;

a power supply and control unit for applying a voltage between said target tank and said charging electrode;

a collector mirror for collecting extreme ultra violet light from the plasma to output the extreme ultra violet light; and a target collecting unit for collecting the target material.

2. The extreme ultra violet light source apparatus according to claim 1, wherein said power supply and control unit applies a direct-current voltage between said target tank and said charging electrode.

3. The extreme ultra violet light source apparatus according to claim 2, wherein the direct-current voltage is no higher than 1 kV.

4. The extreme ultra violet light source apparatus according to claim 1, wherein said charging electrode has one of a cylindrical shape, a parallel plate shape, and a ring shape.

5. The extreme ultra violet light source apparatus according to claim 4, wherein said charging electrode is directly attached to an insulating part of said nozzle.

6. The extreme ultra violet light source apparatus according to claim 4, wherein said charging electrode is arranged so that a position where the stream of the target material from said nozzle is separated into droplets is located at said charging electrode.

7. The extreme ultra violet light source apparatus according to claim 1, further comprising a position adjustment mechanism for adjusting the position of said nozzle.

8. The extreme ultra violet light source apparatus according to claim 1, wherein the stream of the target material becomes droplets to be charged by the charging electrode.

9. An extreme ultra violet light source apparatus for generating extreme ultra violet light from plasma generated by irradiating a target material supplied to a region with a laser beam introduced from an external unit, said apparatus comprising:

a chamber in which the plasma is generated;

a target supply division for supplying the target material to the region within said chamber, including (a) a nozzle for supplying the target material into said chamber, (b) a vibrator for applying vibration to said nozzle, and (c) a target tank for pressurizing the target material stored therein with a gas to supply the target material to said nozzle, a potential of said target tank being set to a ground potential;

a charging electrode disposed between said nozzle and said region;

a control unit for maintaining a voltage between said target tank and said charging electrode to a value no higher than 1 kV;

a collector mirror for collecting extreme ultra violet light from the plasma to output the extreme ultra violet light; and a target collecting unit for collecting the target material.

* * * * *